United States Patent [19]

Coindreau-Palau

[11] Patent Number: 4,984,318

[45] Date of Patent: Jan. 15, 1991

[54] METHOD AND SYSTEM FOR THE RECOVERING OF SOLVENTS IN DRY CLEANING MACHINES

[76] Inventor: Damaso Coindreau-Palau, Bosques de Chapultepec 104, Col. Bosques Del Valle Monterrey, Nuevo Leon, Mexico

[21] Appl. No.: 373,023

[22] Filed: Jun. 28, 1989

[51] Int. Cl.[5] ..... D06B 9/06

[52] U.S. Cl. ..... 8/158; 8/159; 68/18 C

[58] Field of Search ..... 68/18 C, 18 R, 18 F; 8/159, 158

[56] References Cited

U.S. PATENT DOCUMENTS

| | | | |
|---|---|---|---|
| 3,002,287 | 10/1961 | Smith | 68/18 C X |
| 3,391,550 | 7/1968 | Williams | 68/18 C X |
| 3,990,273 | 11/1976 | Schulten et al. | 68/18 C X |
| 4,091,643 | 5/1978 | Zucchini | 68/18 C |
| 4,483,160 | 11/1984 | Jost | 68/18 C |
| 4,817,296 | 4/1987 | Kabakov et al. | 68/18 C |

FOREIGN PATENT DOCUMENTS

| | | | |
|---|---|---|---|
| 1408263 | 10/1975 | United Kingdom | 68/18 C |

*Primary Examiner*—Frankie L. Stinson

*Attorney, Agent, or Firm*—Abelman Frayne Rezac & Schwab

[57] ABSTRACT

In a dry cleaning machine of type that includes, a cleaning chamber adapted for receiving an amount of articles to be washed and dried; means for supplying chemical solvents within of said chamber in order to carry out washing and draining stages of the articles; and, means to produce a flow of hot air within said chamber for drying the articles, a system and method for the additional recovering of solvents is provided. The system including, extract means connected to said chamber for extracting additional solvent from said chamber once the drying stage has been carried out. Condenser means to condense the solvent that has been extracted from said chamber, connected to the extract means to condense the solvent that has been recovered. And, conduit means connected between the condenser means and the means that supplying the chemical solvents for conduit the recovered solvent newly towards the means that supply the solvent.

10 Claims, 1 Drawing Sheet

METHOD AND SYSTEM FOR THE RECOVERING OF SOLVENTS IN DRY CLEANING MACHINES

FIELD OF THE INVENTION

The present invention refers to the dry cleaning of textiles, and more particularly, to a system and a method for recovering chemical solvents which are used in dry cleaning machines for clothes. Similarly, this system and the method of the present invention can be useful in washing electronic parts through the use of chemical solvents.

BACKGROUND OF THE INVENTION

With conventional dry cleaning processes, the articles to be cleaned are placed in a perforated drum of a machine for dry cleaning. Once the articles to be cleaned are placed inside the machine, the drum is filled with solvent and detergents, and turned until all the dirt is removed from the articles.

In reality, the dry cleaning process is carried out via humidity, i.e., instead of washing the articles with soap and water or with detergents, they are treated within a chamber with easily volatile solvents which contain water in suspension via the detergent, but which do not wet clothing or textile articles. Some of the solvents used in this process are perchloroethylene, trichloroethano, trichloro-trifluorethane, carbon tetrachloride, trichloro-ethylene, tetrachloro-ethylene, naptha, etc. These dissolve and remove dirt without any need of wetting and scrubbing the weave.

Once the cleaning process has taken place, the clothing articles or textiles must spin at a high speed in order to extract excess solvent, followed by drying of the articles which is carried out by having them turn slowly in hot air.

While the latter operation is being carried out, the solvent used is filtered to remove the solid dirt particles, followed by a distillation process, which removes the soluble contaminants, leaving again the solvent to reinitiate again another dry cleaning process.

However, one of the principal cost problems of the dry cleaning machines for drying cleaning clothing or electronic parts, is that, once the cleaning, extracted and drying operation has been completed, the air found in the machine still contains some dissolved solvent which is lost at the moment that the main door is open, to discharge the clothing or textile articles from the machine.

This type of natural process losses, added to the losses by leaks or gaskets or badly sealed pipes, result in these types of machines use up a large amount of solvent, thereby increasing costs considerably.

On the other hand, there exists contamination problems due these losses.

Due to the above, the present invention refers to an additional solvent recuperation method for dry cleaning industrial textiles, uniforms, dresses, clothing in general and other types of products, thus reducing the consumption of solvents and environmental contamination.

OBJECTIVES OF THE INVENTION

Therefore, an objective of the present invention is to provide a system for the additional recuperation of solvents in dry cleaning machines, for the dry cleaning of clothing, textiles or other types of articles, which diminishes the losses of solvents during the cleaning and drying of these types of articles. This additional recuperation will involve very low operation costs.

Another objective of the present invention is to provide less atmospheric contamination due to the additional recuperation of solvents in dry cleaning machines.

Still another objective of the present invention is to provide a system for the recuperation of solvents in dry cleaning machines that would diminish the loss of solvents through leaks.

These and other advantages and objectives of the present invention will become clear to the experts in the field from the following detailed description of the invention.

BRIEF DESCRIPTION OF THE INVENTION

FIG. 1 is an schematic description of the dry cleaning machine for the dry cleaning of clothing or textiles in general, including the solvent recovering system of the present invention.

DETAILED DESCRIPTION OF THE INVENTION.

Figure 1:
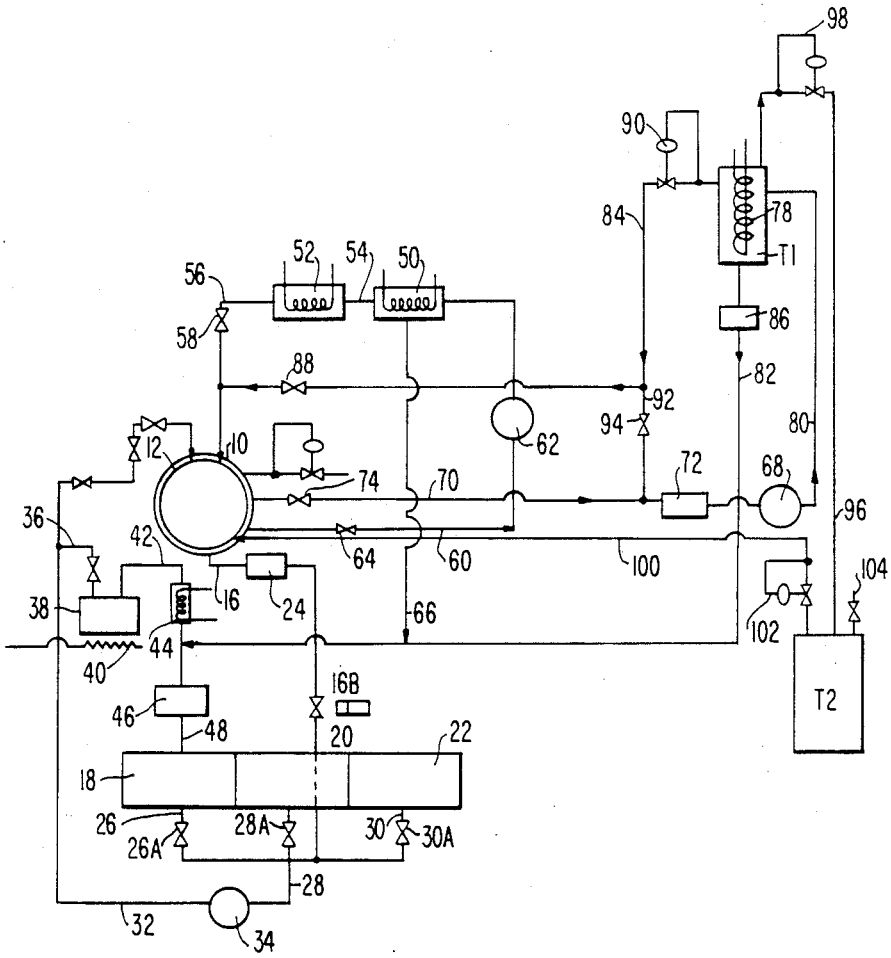

There follows, as an example of the application of this invention, the dry cleaning of clothing process, together with the parts that make up a typical dry cleaning machine, which includes a clothes washing and draining section, as well as a drying section.

WASHING AND DRAINING SECTIONS

Reference to FIG. 1, a schematic diagram of a dry cleaning machine for clothing which includes: a cleaning cylinder 10, having a perforated drum 12, which turns within said cylinder 10 when a cycle of the dry cleaning machine is started; a driving motor (not shown) which turns the perforated drum 12. A first pipe 16 connected between the cylinder 10 and a series of solvent storage tanks 18, 20 and 22. A filter 24 connected to said pipe 16 which filters the solvent and removes solid dirt particles once the dry cleaning cycles have taken place. The storage tanks 18, 20 and 22, including a series of pipes 26, 28 and 30 and their respective valves 26A, 28A and 30A, which communicate to the tanks 18, 20 and 22 for the distribution of the stored solvent. A pipe 32 connected between the pump 34 and cylinder 10, in order to circulate the solvent of said tanks 18, 20 and 22 towards said cylinder 10 once a cleaning cycle is started. A pipe 36 is connected by one end to the pipe 32 and by the other end to a distiller 38. A heater 40 attached to the distiller 38 vaporizes the solvent that passes through said distiller 38. A pipe 42 is connected between the distiller 38 and a condenser 44. The condenser 44 is used in order to have the solvent arrive already distilled to the storage tank 18. A water separator 46 which acts as a settling tank is connected between the condenser 44 and the storage tank 18, through a pipe 48 in order to drain the solvent and pass it to said storage tank 18. The solvent from the dry section is passed similarly through the water separator 46, as will be described later.

DRYING SECTION

This drying section of the machine includes a condenser 50 in order to condense the solvent which is still found inside the cylinder 10; a heater 52 connected through a pipe 54 to said condenser 50, in order to introduce hot air inside cylinder 10. There is a pipe 56 connected between cylinder 10 and heater 52 to conduct the hot air towards the inside of the cylinder 10 for drying the articles. The pipe 56 including a by-pass valve 58 attached between the heater 52 and cylinder 10. A pipe 60 is connected between cylinder 10 and the condenser 50; and, a fan 62 is connected to said pipe 60 in order to extract from the cylinder 10, the air dissolved solvent and make it reach condenser 50. The pipe 60 including a bypass valve 64 attached between the fan 62 the cylinder 10.

A pipe 66 attached between the condenser 60 and pipe 42 conduit the condensed solvent towards the storage tank 18 through the water separator 46.

DRY CLEANING PROCESS

In the conventional dry cleaning process, the articles to be washed are placed inside cylinder 10. Once this operation has been made, solvent with some detergent, is introduced from the storage tank 20 through pipe 32 by pump 34. The solvent and detergent dissolves the grease and remove the dirt particles. This process is assisted by the agitation of the perforated rotating drum 12, in which the articles are placed, until the dirt is removed. Once the washing cycle is ended, the solvent is then drained directly towards the storage tank 20, by opening valves 16B and 28A, passing through filter 24.

Later, once the clothing has been washed with the solvents, the draining of the clothing is started by running at high speed motor (not shown) which turns the drum 12 in order to drain the clothing through the use of centrifugal force. During this draining action, the dirty solvent keeps draining towards tank 20, with valves 16B and 28A in the open position.

When required, the dirty solvent is passed through distiller 38 through pump 34 and pipes 32 and 36 in order to vaporize it. Through pipe 42, the solvent vaporized by the heater 40 is forced to pass through the condenser 44 in order that it arrive already distilled towards the storage tank 18. However, before passing the solvent to said tank 18, it passes through the water separator 46 which acts as a settling tank. It is constructed to take advantage of the wide difference in specific gravity between the solvent and the water. Because the solvent is heavier than the water and does not mix with it, it down to the bottom of the water separator 46 and can be drained and passed to the storage tank 18.

RINSING STAGE

After the washing stage and the draining of the clothing have taken place, the rinsing stage begins. In the cleaning stage, the clean solvent is taken to drum 12, coming from the storage tank 18. Since in this stage the solvent does not come out very dirty, it is discharged directly from drum 12 through pipe 16, and it is passed through filter 24 until it arrives again said tank 20.

DRYING STAGE

Once the draining operation has been carried out in drum 12, the drum is forced to spin at a low speed, and fan 62 begins to work, as well as heater 52 and condenser 50 in order to carry out a partial condensation of the solvent that is still inside cylinder 10. The heater 52 introduces hot air to inside of the cylinder 10 through pipe 56 connected between said cylinder 10 and heater 52 for the drying of the clothing.

As can be observed in FIG. 1, the air with the evaporated solvent which is found inside cylinder 10, is extracted by fan 62 through pipe 60.

Once the air and the solvent arrive at the condenser 50, the condensed solvent must go by pipe 66 towards pipe 42, before the water separator 46 so it will pass to the storage tank 18.

Up to this stage, it could be considered that the conventional dry cleaning process has been already carried out. However, as has already been stated before, the air that is still in the inside of the machine contains some solvent which is lost at the moment that the clothing is taken out of the machine.

ADDITIONAL SOLVENT RECOVERING STAGE

Basically, the solvent recovering system of the present invention includes: a compressor 68; a first pipe 70 connected between the compressor 68 and the cylinder 10 of the machine; a filter 72 and a bypass valve 74 coupled to the said first pipe 70; a storage tank T1; a condenser 78 attached to the internal part of said tank T1, in order to condense the solvent; a second pipe 80 connected between the compressor 68 and the storage tank T1 for make to pass the solvent, that still is found dissolved in the air, through the condenser 78. In FIG. 1, the storage tank T1 includes two exit pipes 82 and 84. Pipe 82 is connected between T1 and pipe 66, so the recovered solvent will go to the storage tank 18. Said pipe 82 including a solving separating tramp 86 which is opened once it contains solvent.

On the other hand, the exit pipe 84 is connected between tank T1 and pipe 56, through valve 88, in order to carry out a full air-solvent mixture recycling cycle in said tank T1. Said pipe 84 including a back pressure regulating valve 90, to keep a constant high pressure inside tank T1. An additional pipe 92 connect the pipes 84 and 70. A valve 94 attached to said pipe 92 prevents the passage of the mixture of air and solvent between said pipes 84 and 70. The valve 94, will only open when a loss of vacuum of the machine is detected, as will be described later.

In accordance with the above, once the drying cycle of the machine takes place, valves 64 and 58 of the pipes 60 and 56 respectively are closed and, valves 74 and 88 are open. Once this operation has been carried out, the compressor 68 starts and it extracts through pipe 70, a mixture of air and solvent from cylinder 10, compressing said mixture and making it pass through condenser 78 in the storage tank T1. As result of the increase in pressure and the cooling heaping inside of the condenser, an additional condensation of the solvent takes place. Later, through pipe 82, the condensed solvent is sent to the storage tank 18. In this operation, the air pressure is raised up to 125 psi or more, and with this, the dissolution capacity of the solvent into the air is reduced. The return of air, which becomes drier through the pipe 84, will permit the carrying out of a continuous cycle for an additional solvent recuperation.

Once the best level of time and percentage of recuperation has been reached, the solvent recuperation stage is finished and the clothing can be discharged from cylinder 10.

Notwithstanding the above, the present invention also includes a system to prevent solvent leaks during washing and drying stages and the full stop of the machine as will be described follow:

Normally, the dry cleaning machines operate at a pressure that is higher than the atmospheric pressure because of the effect provided at the time the solvent get dissolved into the air that is contained within the machine. Therefore, any gasket or pipe that is not well sealed will produce a solvent leak.

Through the present invention, a storage tank T2 is provided, connected to the storage tank T1 by a first pipe 96. The pipe 96 including, a pressure regulating valve 98, in order to control the maximum pressure of tank T1. A second pipe 100 is connected between said tank T2 and cylinder 10 of the machine. The second pipe 100 includes a pressure regulating valve 102 which controls the maximum vacuum of cylinder 10.

Through this system, when a vacuum loss of the machine is detected, the compressor 68 starts working and the valve 74 opens to extract the gas from cylinder 10. Due that in this stage of the process, the gasses that are in the machine could contain a high percentage of solvent, the valve 94 is opened to permit the entrance of dry air to the compressor 68, thus preventing that the gases that pass through the compressor will have an excess of solvent. In other words, the mixture contain shall more air than solvent. With this, the air extracted from the machine produces a pressure increase in tank T1, and at the moment it reaches its maximum pressure, the pressure regulating valve 98 lets gas out to storage tank T2. The pressure in tank T2 will increase. If it goes above the permitted pressure, the remainder will escape through a pressure regulating valve 104 coupled to storage tank T2.

Thus, when the solvent recuperation stage is required to start, cylinder 10 require air, it will be extracted from said tank T2 through valve 102 and pipe 100.

Through this system, a vacuum can be produced in dry cleaning machines, in such way that said machines work with a pressure that is lower than the atmospheric pressure. Therefore, when a solvent leak could take place, instead of losing the solvent, air goes into the system, this air finally will leave the system through the valve 104.

As can be seen from the above, the solvent recuperation system of the present invention lessens the solvent losses when clothing or similar articles are dry cleaned. Operation expenses are as a result, very low.

There follow a reference to the improved method of the present invention for the dry cleaning of clothing or electronic parts through the use of chemical solvents. The method comprising:

providing a cleaning chamber which is adapted to receive a certain amount of articles to be washed;

introducing the articles to be washed within the cleaning chamber;

filling the chamber with chemical solvents;

washing the articles with solvents until all of the dirt from the articles will be removed;

draining the articles and distilling the solvent in order to remove the solid dirt particles and leaving the solvent clean for a new washing cycle; and, drying the article with hot air and completing the cycle of operation of the machine;

finish the cycle of operation of the dry cleaning machine; the method for additional recovering chemical solvents for use in a dry cleaning machine comprising the steps of:

extracting an additional mixture of air and solvent contained in the cleaning chamber at atmospheric pressure, once after the drying stage has been carried out;

compress the air and recovered additional solvent toward a cooling tank for a condensing phase, with high pressure, in order to condense additional solvent that has been extracted from said chamber;

storing the condensed solvent for a new washing cycle; and, extracting the articles from the chamber once the cleaning normal, drying and additional pressurized solvent recuperation cycle has been finished.

The additional pressurized solvent recuperation process comprising further the step of; applying an vacuum effect during the washing, drying and full stop process of the machine.

From the above, it can be observed that the system and method of the present invention considerably reduce the usage of solvents in the dry cleaning machines of clothes, lessening losses because of leaks. This permits and additional recuperation of solvents. Similarly, it lessens environmental contamination.

Finally it must be clear that the invention does not limit itself exclusively to the above presented description and that experts in the filed can, with the teaching provided by this invention, make modifications to the system and process which will clearly be undertending to be within the scope of the invention which is making the following:

I claim:

1. A system for recovering solvents used in dry cleaning machines after an entire cycle of the machine has been competed, of type including:

a cleaning chamber for receiving articles to be washed and dried;

means for supplying chemical solvents to said chamber in order to carry out washing and draining stages on said articles;

means to produce a flow of hot air within said chamber for drying said articles; and, first extraction means connected to the chamber including first condensor means for recovering condensate solvent from said machine upon the completion of the entire cycle of said machine, the system further comprising:

second extraction means connected to said chamber for extracting residual solvent contained within said chamber after a complete cycle of the machine has been carried out, said second extraction means including:

second condenser means to condense solvent extracted from said chamber by said second extraction means and, conduit means connecting said second condenser means and a means for supplying said chemical solvents for returning the recovered solvent to said means for supplying said solvents.

2. The system as claimed in claim 1, wherein the second condenser means comprises:

means to provide a continuous vacuum to the dry cleaning machine during the steps of washing, draining and dull stop for the machine, said vacuum means being connected between said second condenser means and said cleaning chamber, in order to prevent leaks from said machine during the washing of said articles.

3. The system as claimed in claim 2, wherein the means for providing a continuous vacuum to the machine comprises:

a second storage tank for storing recovered gas from said cleaning chamber;

a fifth pipe coupled between said means for solvent condensation and said second tank, in order to reduce pressure within said cleaning chamber; and, a sixth pipe coupled between said second tank and the cleaning chamber in order to supply stored air from said tank to the cleaning chamber when the solvent recycling stage is started.

4. The system as claimed in claim 1, wherein the second extraction means comprises:

a compressor;

first pipes connected between said cleaning chamber and said compressor in order to extract additional air and solvent from said cleaning chamber once the complete cycle of the machine has been finished;

valves attached to each pipe to permit or prevent the flow of air and solvent;

a filter connected to said first pipes, to filter solvent extracted from said cleaning chamber; and, a second pipe connected between said compressor and said second condenser means.

5. The system as claimed in claim 4, wherein said second extraction means further comprises:

a third pipe connected between said means that condense said solvent and the means that supply the solvent; and, a water separator attached to said third pipe.

6. The system as claimed in claim 5, wherein the second extraction means further comprises:

a fourth pipe commented between the solvent condensing means and said cleaning chamber for recirculation of non-condensed solvent through said solvent condensating means, said fourth pipe including an air damper and a bypass valve.

7. The system as claimed in claim 1, wherein the second condenser means for condensing the recovered solvent comprises:

a storage tank; and, a condenser coupled within of said tank for condensing the recycling solvent.

8. In a conventional method for washing and drying of articles in a dry cleaning machines by means of solvents that comprises the steps of:

(a) Providing a cleaning chamber adapted to receive a certain amount of articles to be washed;

(b) introducing the articles to be washed within the cleaning chamber;

(c) filling the chamber with chemical solvents;

(d) washing the articles with said chemical solvents to remove dirt from said articles;

(e) draining the articles and during draining step, distilling the solvent in order to remove solid dirt particles from said solvent leaving the solvent clean for a new washing cycle;

(f) drying the articles with hot air; and, (g) completing the cycle of operation of the dry cleaning machine;

a method for the additional recovery of chemical solvents for use in said dry cleaning machine comprising the steps of:

(h) extracting air and solvent contained in the cleaning chamber after the completion cycle of washing and drying said articles has been carried out;

(i) compressing and then cooling and recovered air and solvent in a condensing stage, at high pressure, in order to recover additional solvent that has been extracted from said cleaning chamber;

(j) storing the recovered solvent for use in a new washing cycle; and, (k) extracting said cleaned articles from said cleaning chamber after the cleaning, drying and additional solvent cycles have been completed.

9. The method as claimed in claim 8, further comprising the steps of:

recycling the air and solvent of stage (h) through said condensation phase until all solvents is condensed.

10. The method as claimed in claim 8, further comprising the step of:

applying a vacuum to said cleaning chamber during the dry cleaning washing process of clothing; and, controlling the extent of said vacuum.

* * * * *